US008973538B2

(12) United States Patent
Dorothy

(10) Patent No.: US 8,973,538 B2
(45) Date of Patent: Mar. 10, 2015

(54) INLINE ENGINE HAVING SIDE-MOUNTED HEAT EXCHANGERS

(75) Inventor: Joshua W. Dorothy, Simpsonville, SC (US)

(73) Assignee: Caterpillar Inc., Peoria, IL (US)

( * ) Notice: Subject to any disclaimer, the term of this patent is extended or adjusted under 35 U.S.C. 154(b) by 1050 days.

(21) Appl. No.: 12/818,713

(22) Filed: Jun. 18, 2010

(65) Prior Publication Data

US 2011/0308486 A1 Dec. 22, 2011

(51) Int. Cl.

| | |
|---|---|
| ***F02B 75/18*** | (2006.01) |
| ***F01P 3/20*** | (2006.01) |
| ***F01P 9/00*** | (2006.01) |
| ***F02B 75/20*** | (2006.01) |
| *F01P 3/18* | (2006.01) |

(52) U.S. Cl.

CPC .. *F02B 75/20* (2013.01); *F01P 3/18* (2013.01)
USPC ..... 123/41.74; 123/41.51; 123/41.01; 165/43

(58) Field of Classification Search

CPC ..... F02B 77/02; F02B 3/06; F02B 19/165; F02B 2019/006; F05C 2201/021; F01L 13/0005; F02D 41/0087; F02F 1/16; F02F 1/14
USPC ..... 123/41.74; 165/41–57
See application file for complete search history.

(56) References Cited

U.S. PATENT DOCUMENTS

| | | | | |
|---|---|---|---|---|
| 2,417,237 | A | 3/1947 | Chandler | |
| 2,670,933 | A * | 3/1954 | Bay | 165/297 |
| 4,187,678 | A | 2/1980 | Herenius | |
| 4,565,175 | A * | 1/1986 | Kaye | 123/542 |
| 4,621,594 | A | 11/1986 | Kubis | |
| 5,839,930 | A * | 11/1998 | Nanami et al. | 440/88 L |
| 6,006,730 | A * | 12/1999 | Rutke et al. | 123/542 |
| 6,145,480 | A | 11/2000 | Betz et al. | |
| 6,394,057 | B1 * | 5/2002 | Fukuoka et al. | 123/195 P |
| 6,457,442 | B1 | 10/2002 | Fuchs et al. | |
| 6,748,906 | B1 * | 6/2004 | White et al. | 123/41.01 |
| 6,793,795 | B1 * | 9/2004 | Meyer et al. | 205/101 |
| 6,981,388 | B2 * | 1/2006 | Brutscher et al. | 62/401 |
| 7,101,238 | B2 * | 9/2006 | Aichinger et al. | 440/88 A |
| 7,249,576 | B2 | 7/2007 | Jones | |
| 7,287,493 | B2 * | 10/2007 | Buck | 123/41.01 |
| 7,328,691 | B2 | 2/2008 | Hataura et al. | |
| 7,430,994 | B2 | 10/2008 | Petutsching et al. | |
| 7,533,636 | B2 | 5/2009 | Marsh et al. | |
| 8,322,155 | B2 * | 12/2012 | Tutunoglu et al. | 62/208 |
| 2003/0205360 | A1 * | 11/2003 | Larson | 165/43 |

FOREIGN PATENT DOCUMENTS

| | | |
|---|---|---|
| EP | 2009259 | 12/2008 |

* cited by examiner

*Primary Examiner* — Lindsay Low
*Assistant Examiner* — Syed O Hasan
(74) *Attorney, Agent, or Firm* — Finnegan, Henderson, Farabow, Garrett & Dunner, LLP

(57) ABSTRACT

An engine is disclosed. The engine may have an engine block with a front end, a back end opposite the front end in a length direction, a first side, a second side opposite the first side, a top, and a bottom opposite the top. The engine may also have at least one cylinder head connected to the top of the engine block, and a first heat exchanger mounted at the first side of the engine block and configured to receive a flow of raw coolant and a flow of fresh coolant. The engine may further have a second heat exchanger mounted at the first side of the engine block, between the first heat exchanger and the top. The second heat exchanger may be configured to receive a flow of fresh coolant from the first heat exchanger and a flow of combustion air.

19 Claims, 3 Drawing Sheets

INLINE ENGINE HAVING SIDE-MOUNTED HEAT EXCHANGERS

TECHNICAL FIELD

The present disclosure relates generally to an engine and, more particularly, to an inline engine having side-mounted heat exchangers.

BACKGROUND

Engines, including diesel engines, gasoline engines, and gaseous fuel-powered engines, typically combust a fuel/air mixture to generate mechanical, hydraulic, or electrical power output. In order to ensure optimum combustion of the fuel/air mixture and simultaneously protect components of the engine from damaging extremes, temperatures of the engine and air drawn into the engine for combustion should be tightly controlled. For this reason, an internal combustion engine is generally fluidly connected to several different liquid-to-liquid, liquid-to-air, and/or air-to-air heat exchangers to cool both liquids and gases circulated throughout the engine.

One way of packaging heat exchangers on an inline marine engine is disclosed in U.S. Pat. No. 7,287,493 of Buck that issued on Oct. 30, 2007 (the '493 patent). The engine of the '493 patent is equipped with a turbocharger, a turbo jacket cooler, an intercooler, a jacket water heat exchanger, an engine oil cooler, a secondary fluid cooler (e.g., a transmission oil cooler), a primary water pump, and a raw water pump. The turbocharger is mounted at one end of the engine and outfitted with the turbo jacket cooler. The intercooler is mounted directly to cylinder heads of the engine on a side of the engine opposite from the jacket water heat exchanger. An engine oil cooler is mounted to a side of an engine block, below the jacket water heat exchanger. The secondary fluid cooler is located on a front end of the engine. The primary water pump is also located at the front end of the engine, while the raw water pump is mounted to the engine block at an end of the engine oil cooler below the jacket water heat exchanger. The raw water pump circulates sea water through the turbocharger cooling jacket, the intercooler, the jacket water heat exchanger, and the secondary cooler. The primary water pump circulates fresh water through the jacket water heat exchanger, the engine, and the oil cooler.

The disclosed engine is directed to overcoming one or more problems of the prior art.

SUMMARY

In one aspect, the present disclosure is directed to an engine. The engine may include an engine block with a front end, a back end opposite the front end in a length direction, a first side, a second side opposite the first side, a top, and a bottom opposite the top. The engine may also include at least one cylinder head connected to the top of the engine block, and a first heat exchanger mounted at the first side of the engine block and configured to receive a flow of raw coolant and a flow of fresh coolant. The engine may further include a second heat exchanger mounted at the first side of the engine block and configured to receive fresh coolant from the first heat exchanger and a flow of combustion air.

In another aspect, the present disclosure is directed to another engine. This engine may include an engine block having a front end, a back end opposite the front end, a first side, a second side opposite the first side, a top, and a bottom opposite the top. The engine may also include at least one cylinder head connected to the top of the engine block, a first heat exchanger mounted at the first side of the engine block and configured to receive a flow of raw coolant and a flow of fresh coolant, and a second heat exchanger mounted at the second side of the engine block and configured to receive a flow of raw coolant and a flow of fresh coolant. The engine may further include a raw coolant pump mounted at the second side of the engine block and having an inlet located at an elevation between the top of the engine block and the first and second heat exchangers.

DETAILED DESCRIPTION

Figure 1:
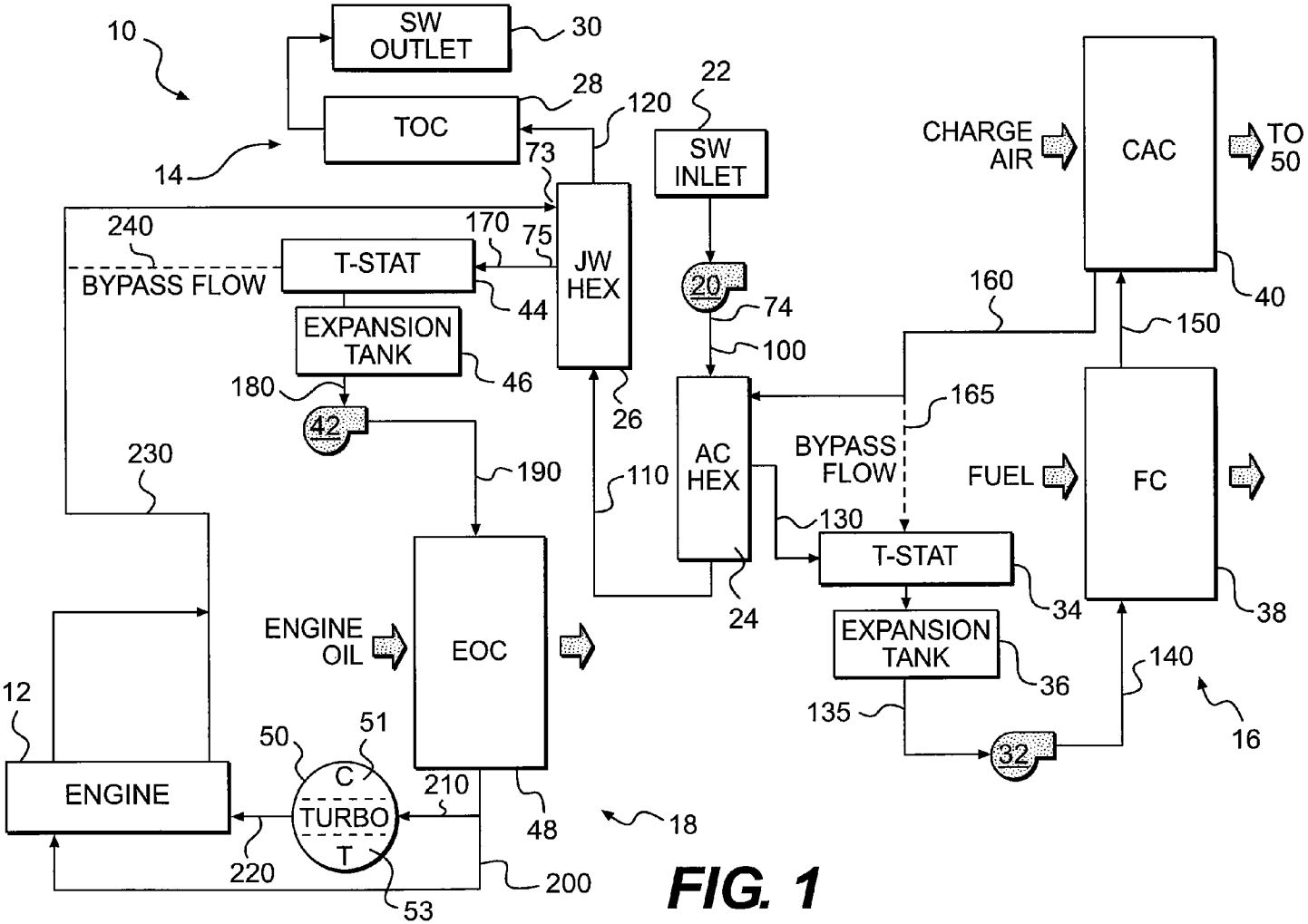
FIG. 1 is a schematic illustration of an exemplary disclosed cooling system.

FIG. 1 illustrates an exemplary disclosed cooling system 10 associated with an inline internal combustion engine 12, for example a diesel, gasoline, or gaseous fuel powered engine. Cooling system 10 may include a first circuit 14, a second circuit 16, and a third circuit 18. Fluid flows may be regulated through the different circuits of cooling system 10 to regulate temperatures of engine 12.

First circuit 14 may be a raw coolant circuit. In the exemplary embodiment, engine 12 is a marine engine and, for the purposes of this disclosure, the term raw coolant may be considered a coolant taken from the environment of engine 12, for example sea water. Raw coolant may be drawn by a raw coolant pump 20 into first circuit 14 via an inlet 22. Raw coolant pump 20 may circulate raw coolant through a passage 100 to an aftercooler heat exchanger (AC hex) 24 and then through a passage 110 to a jacket water heat exchanger (JW Hex) 26. After exiting JW hex 26, the raw coolant may be directed through a passage 120 to a secondary heat exchanger, for example a transmission oil cooler (TOC) 28, before discharge back to the environment via an outlet 30.

Second circuit 16 may be a fresh coolant circuit configured to transfer heat from engine 12 to the raw coolant of first circuit 14. For the purposes of this disclosure, the term fresh coolant may be considered a coolant kept onboard engine 12 in a closed circuit, typically water or a water/glycol mixture. Second circuit 16 may include a pump 32 that circulates the fresh coolant of second circuit 16 through AC hex 24 where heat may be transferred from the fresh coolant to the raw coolant. After exiting AC hex 24, the fresh coolant may circulate through a passage 130 to a thermostat (T-stat) 34 and then to an expansion tank 36 located just upstream of pump 32. Pump 32 may be connected to expansion tank 36 via a passage 135. From pump 32, the fresh coolant may be circulated through a passage 140 to a secondary heat exchanger, for example a fuel cooler (FC) 38, and through a passage 150 to a charge air cooler (CAC) 40 where heat may be transferred from combustion air entering engine 12 to the fresh coolant. By locating FC 38 upstream of CAC 40, FC 38 may experience low coolant temperatures without significantly affecting operation of CAC 40. The fresh coolant may circulate from CAC 40 through a passage 160 to AC hex 24 and then to expansion tank 36 via passage 130 and T-stat 34. Alternatively, the coolant may bypass AC hex 24 and flow from CAC 40 directly to T-stat 34 via a passage 165 and, if desired.

Third circuit 18 may also be a fresh coolant circuit configured to transfer heat from engine 12 to the raw coolant of first circuit 14. Third circuit 18 may include a pump 42 that circulates the fresh coolant of third circuit 18 through JW hex 26 where heat may be transferred from the fresh coolant to the raw coolant. After exiting JW hex 26, the fresh coolant may circulate through a passage 170 to a thermostat (T-stat) 44 and then to an expansion tank 46 located just upstream of pump 42. Pump 42 may be connected to expansion tank 46 via a passage 180. From pump 42, the fresh coolant may be circulated through a passage 190 to a secondary heat exchanger, for example an engine oil cooler (EOC) 48, before being directed through a passage 200 into engine 12. A parallel flow of fresh coolant may also flow from EOC 48 through a passage 210 to a turbocharger 50 before being directed through a passage 220 into engine 12. After exiting engine 12, the fresh coolant may flow through a passage 230 to JW hex 26 and then back to expansion tank 46 via T-stat 44. Alternatively, the fresh coolant from engine 12 may bypass JW hex 26 and flow directly to T-stat 44 via a passage 240, if desired. By locating EOC 48 upstream of engine 12, EOC 48 may experience low coolant temperatures without significantly affecting cooling of engine 12.

Each of pumps 20, 32, and 42 may be engine-driven to generate the flows of coolant described above. In particular, pumps 20, 32, and 42 may each include an impeller (not shown) disposed within a volute housing having an inlet and an outlet. As the coolant enters the volute housing, blades of the impeller may be rotated by operation of engine 12 to push against the coolant, thereby circulating the coolant through cooling system 10. An input torque imparted by engine 12 to pumps 20, 32, and 42 may be related to a pressure of the coolant, while a speed imparted to pumps 20, 32, and 42 may be related to a flow rate of the coolant. It is contemplated that pumps 20, 32, and 42 may alternatively embody piston type pumps, if desired, and may have a variable or constant displacement.

Each of AC hex 24, JW hex 26, TOC 28, FC 38, and EOC 48 may be a liquid-to-liquid type heat exchanger configured transfer heat either from the fresh coolant to the raw coolant or from another operating fluid (e.g., oil, fuel, etc.) to the fresh coolant. For example, AC hex 24, JW hex 26, TOC 28, FC 38, and EOC 48 may each embody a flat-plate heat exchanger or a tube-and-bundle heat exchanger. As a primary flow of fluid passes through the respective heat exchanger, it may conduct heat through internal walls of the heat exchanger to a secondary flow of fluid also passing through the heat exchanger. It is contemplated that the primary and secondary flows of fluid may be parallel flows, opposite flows, or cross flows, as desired.

CAC 40 may be a liquid-to-air heat exchanger configured to transfer heat from combustion air entering engine 12 to the fresh coolant of second circuit 16. That is, a flow of charged air exiting turbocharger 50 may be directed through channels of CAC 40 such that heat from the coolant in adjacent channels is transferred to the air. In this manner, the combustion air entering engine 12 may be cooled to a desired operating temperature.

T-stats 34 and 44 may be used to regulate a temperature of the fresh coolant passing through second and third circuits 16, 18, respectively. Specifically, in response to a desired temperature of the respective fresh coolant flows, valves (not shown) within T-stats 34, 44 may selectively move to restrict or even block fresh coolant from passing through AC and JW hexes 24, 26. In this manner, the amount of heat transfer from the fresh coolant flows to the raw coolant may be controlled.

Turbocharger 50 may include a compressor side 51 and a turbine side 53 connected to each other by way of a shaft. Exhaust passing through turbine side 53 of turbocharger 50 may drive compressor side 51 via the shaft to pressurize combustion air. Compressor side 51 of turbocharger 50 may be located upstream of CAC 40 such that the pressurized combustion air is cooled prior to entering engine 12.

Figure 2:
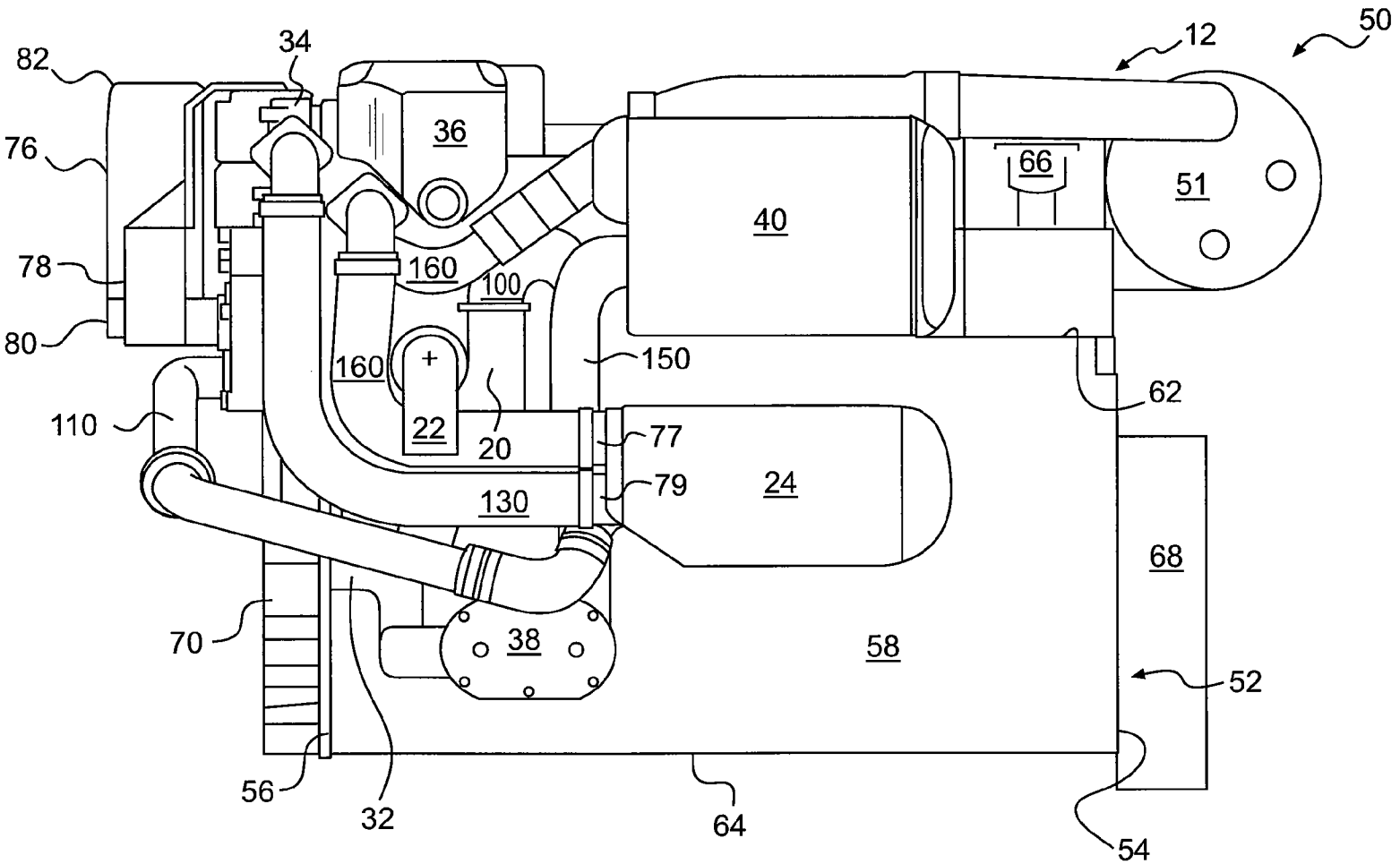
FIG. 2 is a left side view of an exemplary disclosed engine incorporating the cooling system of FIG. 1.
Figure 3:
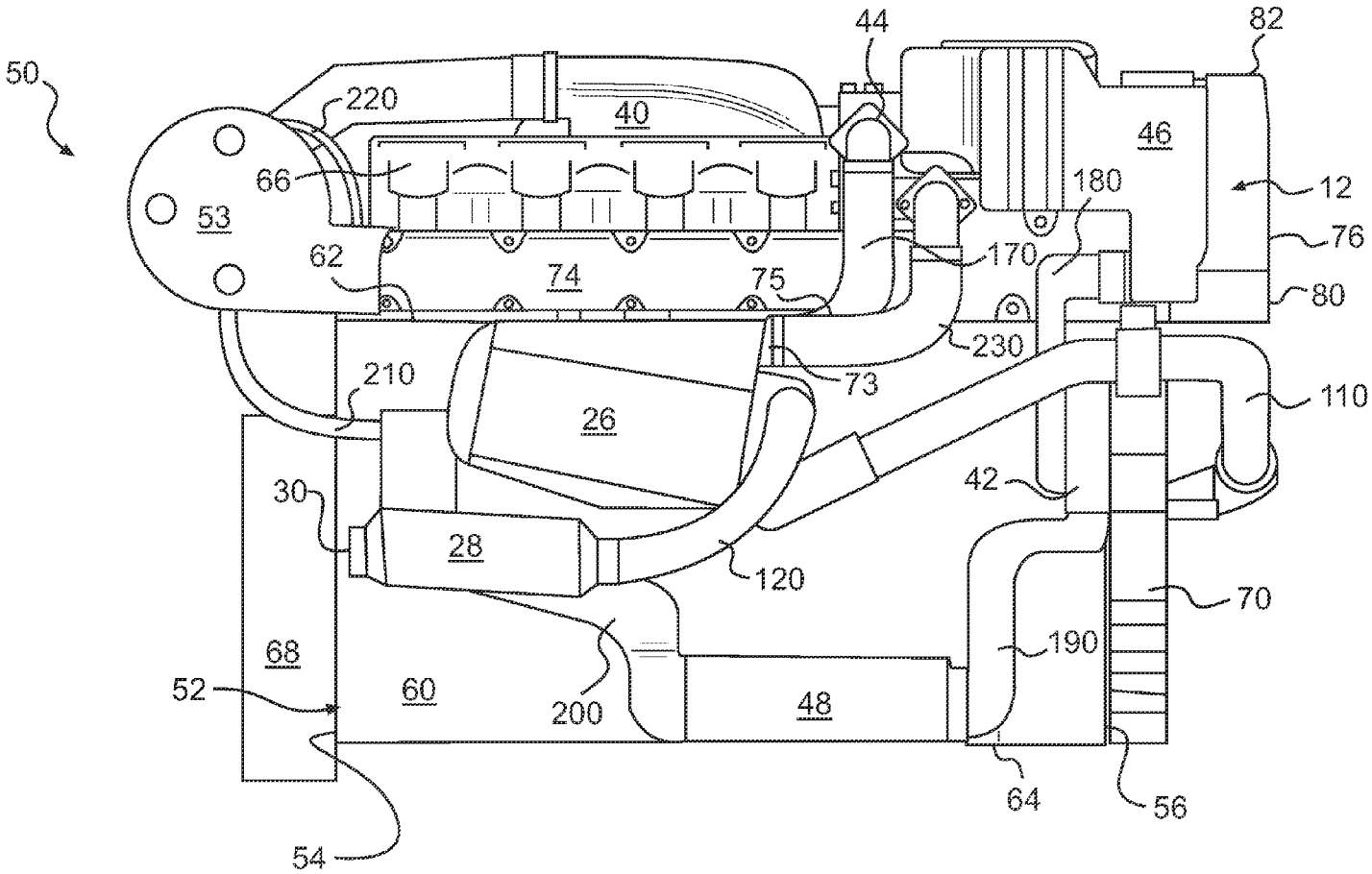
FIG. 3 is right side view of the engine of FIG. 2.

FIGS. 2 and 3 illustrate physical locations of the components of cooling system 10 relative to engine 12. As shown in these figures, engine 12 may include an engine block 52 having a front end 54, a back end 56 opposite front end 54 in a length direction, a first side 58 (e.g., a right side shown FIG. 2), a second side 60 (e.g., a left side shown in FIG. 3) opposite first side 58 in a horizontal direction, a top 62, and a bottom 64 opposite top 62 in a vertical direction. Engine 12 may also include at least one cylinder head 66 connected to top 62 of engine block 52, a front housing 68 connected to front end 54, and a back housing 70 connected to back end 56. Cylinder head 66 may cap off one or more inline cylinders (i.e., cylinders aligned in the vertical direction of engine block 52) of engine 12 to at least partially define one or more combustion chambers (not shown). In the illustrated embodiment, a one-piece cylinder head 66 is shown as capping off three different cylinders to define three different combustion chambers, although any number of cylinder heads 66 may be utilized. Front housing 68 may facilitate a fly-wheeled connected to a transmission or generator (not shown). Back housing 70 may facilitate power distribution from a crankshaft (not shown) of engine 12 to engine-driven components, for example to pumps 20, 32, and 42. The components of cooling system 10, as will be described in more detail below, may be mounted to engine block 52, cylinder head 66, front housing 68, and back housing 70 in a manner that enhances operation of cooling system 10 and reduces packaging costs.

For example, FIG. 2 shows raw coolant pump 20 as being mounted at first side 58 of engine block 52 and including inlet 22 fixedly connected to pump 20 and oriented downward toward bottom 64 of engine block 52. A connection of pump 20 with inlet 22 (indicated by a + sign) may be located at about the intersection of top 62 and first side 58. As will be described in more detail below, this location, in conjunction with an elevation of passage 110, may help to retain raw coolant within the heat exchangers of cooling system 10, even when engine 12 is non-operational.

AC hex 24, T-stat 34, expansion tank 36, and FC 38 are shown in FIG. 2 as also being mounted at first side 58, near raw coolant pump 20. In one embodiment, AC hex 24 may be mounted to have a length direction generally aligned with a length direction of engine block 54, and be located forward of and nearer to bottom 64 than raw coolant pump 20 (i.e., located in the length direction of block 52 between raw coolant pump 20 and front end 54 and in the vertical direction between raw coolant pump 20 and bottom 64). T-stat 34 and expansion tank 36 may be located almost directly above coolant pump 20 (e.g., slightly more toward back end 56), while FC 38 may be mounted closer to back end 56 and bottom 64 of engine block 52 than AC hex 24, but closer to front end 54 than raw coolant pump 20. By locating AC hex 24 below inlet 22 of raw coolant pump 20 and below a high point of passage 110, it may be ensured that AC hex 24 remains full of raw coolant, even when engine 12 is non-operational. When the engine components are full of coolant, oxygen in the air may have little affect on corrosion of the components. Further, by co-locating AC hex 24, T-stat 34, expansion tank 36, FC 38, and raw coolant pump 20 at first side 58, plumbing between these components may be reduced (i.e., lengths of passages 130-165 may be reduced).

CAC 40 may be mounted to cylinder head 66 at first side 58 of engine block 52 to have a length direction generally aligned with a length direction of engine block 54, in a location closer to front end 54 than to back end 56. In one embodiment, CAC 40 may be located at about the same location in the length direction of engine block 52 as AC hex 24 (i.e., in general alignment along the length direction). By mounting CAC 40 to cylinder head 66 and by co-locating raw AC hex 24 and CAC 40 at first side 58, plumbing between these components may be reduced.

Turbocharger 50 may be mounted at front end 54 of engine block 52, with compressor side 51 oriented toward first side 58 of engine block 52 and turbine side 53 oriented toward second side 60. In this manner, charged air exiting turbocharger 50 may be routed directly to CAC 40 via a short section of piping, thereby reducing an amount of heat dissipated from the charged air to a customer's engine room. Similarly, hot exhaust gas exiting engine 12 may be directed via a short section of exhaust manifold 74 to turbine side 53 of turbocharger 50, also thereby reducing an amount of heat dissipated to the customer's engine room.

FIG. 3 shows JW hex 26 mounted at second side 60 of engine block 52 to have a length direction generally aligned with a length direction of engine block 54, at a location below exhaust manifold 74 (i.e., between exhaust manifold 74 and bottom 64 of engine block 52) and further toward front end 54 than back end 56. In one embodiment, JW hex 26 may be substantially identical to AC hex 24, but mounted in an orientation different than that of AC hex 24. In particular, a fresh water inlet 73 and a fresh water outlet 75 of JW hex 26 may be generally aligned in the horizontal direction of engine block 52 and located relatively close to engine block 52, while a fresh water inlet 77 and a fresh water outlet 79 of AC hex 24 may be generally aligned in the vertical direction of engine block 52 and located further away from engine block 52. Because JW hex 26 and AC hex 24 may be identical components, tooling required to fabricate these components may be reduced. In addition, the ability to mount JW hex 26 and AC hex 24 in different orientations may allow for mounting flexibility and improved use of space on engine 12. The location of JW hex 26 low on engine block 52 (i.e., below the high point of passage 110), in conjunction with a relatively high outlet location of passage 120 (indicated by a "+" symbol) may help ensure that JW hex 26 remains full of raw coolant even when engine 12 is non-operational. Further, the location of JW hex 26 below exhaust manifold 74, may help protect JW hex 26 from being damaged from above, for example by falling tools, parts, or debris.

EOC 48 may be located at second side 60, below JW hex 26 and closer to back housing 70 than to front housing 68. This low location on engine block 52 may help ensure that EOC 48 remains full of fresh coolant and oil, even when engine 12 is non-operational.

Because the heat exchangers of cooling system 10 may be mounted at the sides of engine 12 (i.e., to the sides of engine block 52 and cylinder head 66), the back end of engine 12 may be relatively free of cooling components and available for mounting other components. In the embodiment of FIGS. 2 and 3, serviceable components may be mounted to back housing 70. For example one or more filters such as engine oil filters 76 or fuel filters 78 (shown only in FIG. 2) may be mounted to back housing 70.

Engine oil filters 76 may each include a base end 80 connected to back housing 70, and a free distal end 82. Engine oil filters 76 may be upside-down, such that free distal ends 82 extend upward away from base ends 80 and are gravitationally higher. The location of serviceable components on the back end of engine 12 may improve access to these components, while the upside-down orientation of engine oil filters 76 may allow service from above engine 12.

Industrial Applicability

The disclosed cooling system arrangement may be used in any internal combustion engine where component life and system packaging are an issue. The disclosed cooling system finds particular applicability with inline combustion engines, where a space between opposing banks of cylinders is unavailable for packaging use. As described above, components of the disclosed cooling system may be mounted to the inline combustion engine in locations at the sides of the engine that enhance performance and longevity of the system, while simultaneously reducing system size and customer cost.

It will be apparent to those skilled in the art that various modifications and variations can be made to the disclosed engine and cooling system without departing from the scope of the disclosure. Other embodiments of the disclosed engine and cooling system will be apparent to those skilled in the art from consideration of the specification and practice of the engine disclosed herein. For example, although relative placement of cooling system components has been described with respect to a front end and a back end of engine 12, it is contemplated that the front and back ends of engine 12 may be reversed, if desired. Further, the components described as being mounted at a side of engine 12, may be directly mounted to engine block 52 and/or cylinder head 66 or indirectly mounted via a bracket or another passage, as desired. It is intended that the specification and examples be considered as exemplary only, with a true scope of the disclosure being indicated by the following claims and their equivalents.

What is claimed is:

1. An engine, comprising:

an engine block having a front end, a back end opposite the front end in a length direction, a first side, a second side opposite the first side in a horizontal direction, a top, and a bottom opposite the top in a vertical direction;

at least one cylinder head connected to the top of the engine block and position above the top of the engine block with respect to the vertical direction;

a first heat exchanger mounted at the first side of the engine block and configured to receive a flow of raw coolant and a flow of fresh coolant;

a second heat exchanger mounted at the first side of the engine bock and configured to receive fresh coolant from the first heat exchanger and a flow of combustion air;

a jacket water heat exchanger mounted at the second side of the engine block and configured to receive a flow of raw coolant and a flow of fresh coolant; and an inlet for receiving raw coolant located at an elevation between the top of the engine block and the first heat exchanger and jacket water heat exchanger with respect to the vertical direction.

2. The engine of claim 1 wherein the first and second heat exchangers are generally aligned with each other in the length direction of the engine block, and each of the first and second heat exchangers has a length direction generally aligned with the length direction of the engine block.

3. The engine of claim 1, further including a turbocharger located at the front end of the engine block and configured to provide a flow of pressurized combustion air to the second heat exchanger, wherein the second heat exchanger is located closer to the front end than to the back end of the engine block.

4. The engine of claim 3, wherein the turbocharger has a compressor side oriented toward the first side of the engine block, and a turbine side oriented toward the second side of the engine block.

5. The engine of claim 1, wherein the jacket water heat exchanger is substantially identical to the first heat exchanger.

6. The engine of claim 1, further including an exhaust manifold mounted to the at least one cylinder head at the second side of the engine block opposite the second heat exchanger, wherein the jacket water heat exchanger is mounted at the second side of the engine block between the exhaust manifold and the bottom of the engine block.

7. The engine of claim 4, further including a raw coolant pump mounted at the first side of the engine block.

8. The engine of claim 1, further including an engine oil heat exchanger mounted at the second side of the engine block, between the jacket water heat exchanger and the bottom of the engine block.

9. The engine of claim 1, further including a transmission oil heat exchanger mounted at the second side of the engine block and fluidly connected to the jacket water heat exchanger.

10. The engine of claim 9, further including a fuel heat exchanger mounted at the first side of the engine block and fluidly connected to the second heat exchanger.

11. The engine of claim 10, further including a plurality of serviceable components mounted to the back end of the engine block.

12. The engine of claim 11, wherein the plurality of serviceable components includes at least one filter having a base end mounted to the engine block and a distal free end, wherein the distal free end is located gravitationally higher than the base end.

13. An engine, comprising:

an engine block having a front end, a back end opposite the front end in a length direction, a first side, a second side opposite the first side in a horizontal direction, a top, and a bottom opposite the top in a vertical direction;

at least one cylinder head connected to the top of the engine block and position above the top of the engine block with respect to the vertical direction;

a first heat exchanger mounted at the first side of the engine block and configured to receive a flow of raw coolant and a flow of fresh coolant;

a second heat exchanger mounted at the second side of the engine block and configured to receive a flow of raw coolant and a flow of fresh coolant;

a third heat exchanger mounted at the second side of the engine block and configured to receive a flow of fresh coolant from the second heat exchanger and a flow of combustion air; and a ray coolant pump mounted at the second side of the engine block and having an inlet located at an elevation between the top of the engine block and the first and second heat exchanger with respect to the vertical direction.

14. The engine of claim 13, wherein the first and second heat exchangers are substantially identical.

15. The engine of claim 13, further including an exhaust manifold mounted to the at least one cylinder head at the first side of the engine block opposite the second heat exchanger, wherein the first heat exchanger is mounted between the exhaust manifold and the bottom of the engine block.

16. The engine of claim 13, further including an engine oil heat exchanger mounted at the first side of the engine block between the first heat exchanger and the bottom of the engine block.

17. The engine of claim 16, further including:

a transmission oil heat exchanger mounted at the first side of the engine block and fluidly connected to the first heat exchanger; and a fuel heat exchanger mounted at the second side of the engine block and fluidly connected to the second heat exchanger.

18. The engine of claim 17, further including at least one filter having a base end mounted to the front end of the engine block and a distal free end, wherein the distal free end is located gravitationally higher than the base end.

19. The engine of claim 13, wherein the second heat exchanger is mounted between the third heat exchanger and the bottom of the engine block.

* * * * *

UNITED STATES PATENT AND TRADEMARK OFFICE

CERTIFICATE OF CORRECTION

PATENT NO. : 8,973,538 B2
APPLICATION NO. : 12/818713
DATED : March 10, 2015
INVENTOR(S) : Joshua W. Dorothy It is certified that error appears in the above-identified patent and that said Letters Patent is hereby corrected as shown below:

In the Specification:

Column 6, line 1, delete "Industrial Applicability" and insert -- INDUSTRIAL APPLICABILITY --.

In the Claims:

Column 6, line 38, in Claim 1, delete "position" and insert -- positioned --.

Column 6, line 54, in Claim 1, delete "claim 1" and insert -- claim 1, --.

Column 7, line 35, in Claim 13, delete "position" and insert -- positioned --.

Column 8, line 8 (Approx.), in Claim 13, delete "ray" and insert -- raw --.

Signed and Sealed this
Nineteenth Day of January, 2016

Michelle K. Lee

Michelle K. Lee
*Director of the United States Patent and Trademark Office*